US008060958B1

(12) United States Patent
Hough

(10) Patent No.: US 8,060,958 B1
(45) Date of Patent: Nov. 22, 2011

(54) POWERED PERSON LIFT AND TRANSPORT APPARATUS

(76) Inventor: Randall Hough, Lily, SD (US)

( * ) Notice: Subject to any disclaimer, the term of this patent is extended or adjusted under 35 U.S.C. 154(b) by 361 days.

(21) Appl. No.: 12/479,951

(22) Filed: Jun. 8, 2009

(51) Int. Cl.
*A61G 7/12* (2006.01)

(52) U.S. Cl. ..... 5/83.1; 5/86.1; 5/87.1

(58) Field of Classification Search ..... 5/81.1 R, 5/83.1, 85.1–87.1, 89.1
See application file for complete search history.

(56) References Cited

U.S. PATENT DOCUMENTS

| | | | | | |
|---|---|---|---|---|---|
| 4,484,366 | A | * | 11/1984 | Koontz | 5/83.1 |
| 4,704,749 | A | * | 11/1987 | Aubert | 5/87.1 |
| 5,022,106 | A | | 6/1991 | Richards | |
| 5,076,448 | A | | 12/1991 | Ballard | |
| 5,265,689 | A | | 11/1993 | Kauffmann | |
| 5,309,584 | A | | 5/1994 | Parker | |
| 5,369,821 | A | | 12/1994 | Richards | |
| 5,708,993 | A | * | 1/1998 | Campbell et al. | 5/86.1 |
| 5,758,371 | A | * | 6/1998 | VanDyke et al. | 5/86.1 |
| 6,175,973 | B1 | * | 1/2001 | Hakamiun et al. | 5/89.1 |
| 6,449,785 | B1 | * | 9/2002 | Liljedahl | 5/89.1 |
| 6,671,899 | B1 | | 1/2004 | Oja | |
| 7,346,941 | B1 | | 3/2008 | Ein | |
| 7,356,858 | B2 | | 4/2008 | Summers | |
| 7,392,554 | B1 | | 7/2008 | Su | |
| 7,506,388 | B1 | * | 3/2009 | Brown | 5/86.1 |
| 7,634,824 | B2 | * | 12/2009 | Gramkow et al. | 5/81.1 R |
| 7,669,255 | B2 | * | 3/2010 | Raney | 5/86.1 |
| 7,921,486 | B2 | * | 4/2011 | Biersteker et al. | 5/87.1 |
| 2001/0027574 | A1 | | 10/2001 | Bouhuys | |
| 2006/0137091 | A1 | | 6/2006 | Gramkow | |
| 2009/0249544 | A1 | * | 10/2009 | Palay et al. | 5/83.1 |

* cited by examiner

*Primary Examiner* — Michael Trettel
(74) *Attorney, Agent, or Firm* — Jeffrey A. Proehl; Woods, Fuller, Shultz and Smith, PC

(57) ABSTRACT

A powered lift apparatus for lifting and transporting a human body above a ground surface is disclosed, and comprises a base, a mast extending upwardly from the base, and a crane member pivotally mounted on the mast and movable with respect to the base. The apparatus further comprises a hydraulic drive mechanism configured to move the base over the surface and a hydraulic lifting mechanism configured to move the crane member with respect to the base. The apparatus also comprises a single hydraulic power source assembly connected to and powering both the hydraulic drive mechanism and the hydraulic lifting mechanism. The hydraulic power source assembly includes a control assembly configured to direct hydraulic power from the hydraulic power source assembly to the hydraulic drive mechanism and hydraulic lifting mechanism under user control.

16 Claims, 4 Drawing Sheets

POWERED PERSON LIFT AND TRANSPORT APPARATUS

BACKGROUND

1. Field

The present disclosure relates to a person lifting and transporting apparatus and more particularly pertains to a new powered person lift and transport apparatus utilizing a unified hydraulic power source for both moving the apparatus across a ground surface and for lifting and lowering a human body.

2. Description of the Prior Art

Lifting apparatus, such as those directed to lift and transport invalids or individuals otherwise unable to change their physical location under their own strength, typically include some type of lifting element mounted on a mobile base. Some lifting apparatus operate entirely under manual control, whereby lifting of a human is actuated with a manually-actuated mechanism, and movement of the lifted human is executed by physically pushing the lifting apparatus on free-spinning wheels.

However, known systems for lifting and transporting human bodies tend to be bulky and complicated, rely upon motors which are highly sensitive to weight and lack means for propelling the body to a desired location. The significant weight and bulk of these apparatus make it difficult to move the apparatus from one point to another and maneuver the apparatus around obstacles such as furniture, and through doors and other confined areas.

It is therefore believed that there is a need for a new powered person lift and transport apparatus which is simple and less complicated, uses motors which are not sensitive to weight and includes a means for propelling a lifted body to a desired location.

SUMMARY

In view of the foregoing disadvantages inherent in the known types of lifting devices now present in the prior art, the present disclosure describes a new powered person lift and transport apparatus utilizing a unified hydraulic power source for both moving the apparatus across a ground surface and for lifting and lowering a human body.

The present disclosure relates to a powered lift apparatus for lifting and transporting a human body above a ground surface. The apparatus comprises a base, a mast extending upwardly from the base, and a crane member pivotally mounted on the mast and movable with respect to the base. A hydraulic drive mechanism is configured to move the base over the surface, and a hydraulic lifting mechanism is configured to move the crane member with respect to the base. A hydraulic power source assembly is connected to and powers both the hydraulic drive mechanism and hydraulic lifting mechanism. The hydraulic power source assembly includes a control assembly configured to direct hydraulic power from the hydraulic power source assembly to the hydraulic drive mechanism and hydraulic lifting mechanism under user control.

There has thus been outlined, rather broadly, some of the more important elements of the invention in order that the detailed description thereof that follows may be better understood, and in order that the present contribution to the art may be better appreciated. There are additional elements of the invention that will be described hereinafter and which will form the subject matter of the claims appended hereto.

In this respect, before explaining at least one embodiment or implementation in greater detail, it is to be understood that the scope of the invention is not limited in its application to the details of construction and to the arrangements of the components, as well as the particulars of the steps of usage, set forth in the following description or illustrated in the drawings. The invention is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present invention.

The advantages of the various embodiments of the present invention, along with the various features of novelty that characterize the invention, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
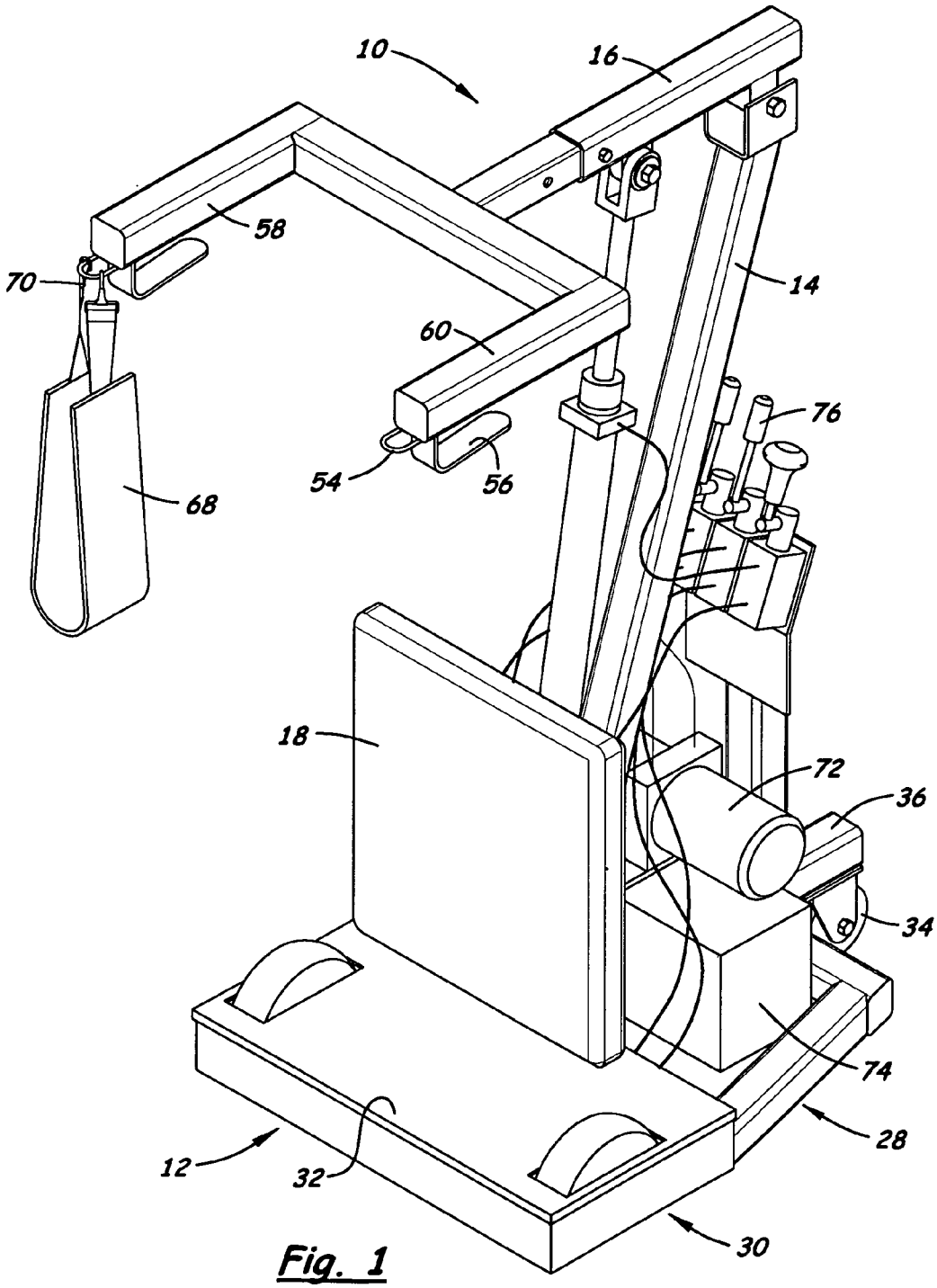
FIG. 1 is a schematic perspective view of a new powered person lift and transport apparatus according to the present disclosure from a forward aspect.
Figure 2:
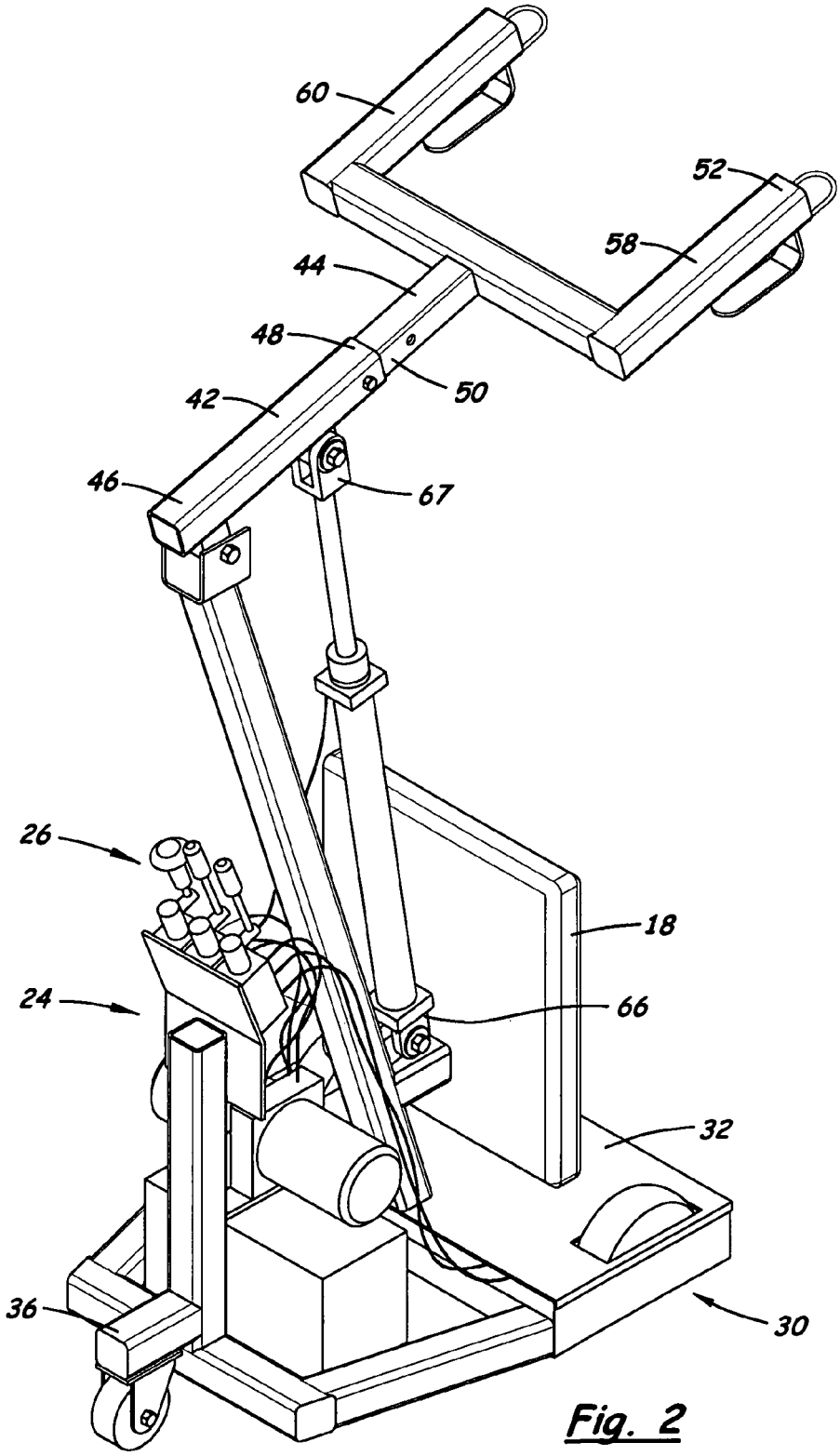
FIG. 2 is a schematic perspective view of the powered person lift and transport apparatus according to the present disclosure from a rearward aspect.
Figure 3:
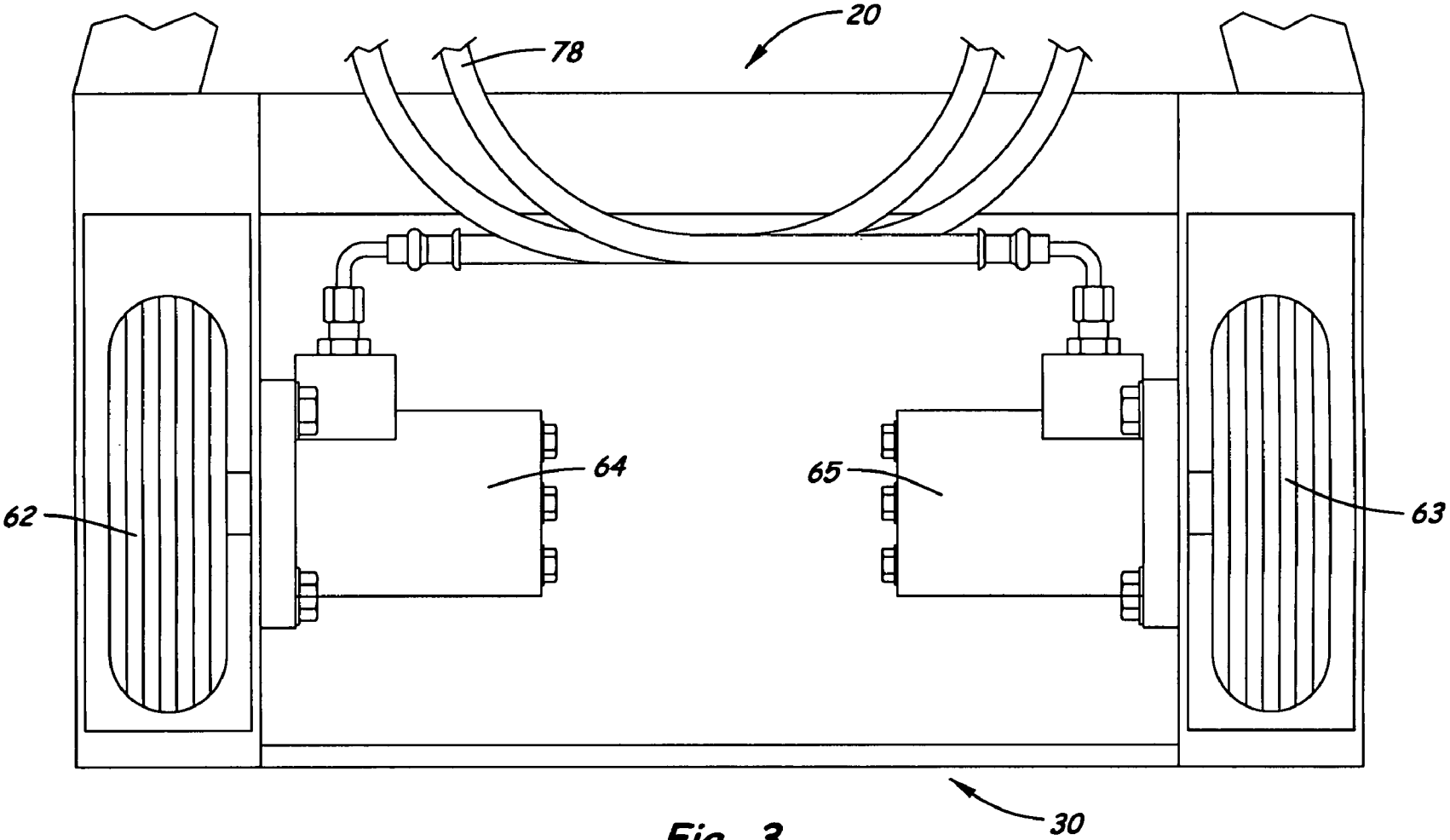
FIG. 3 is a schematic top view of the hydraulic drive mechanism of the powered person lift and transport apparatus.
Figure 4:
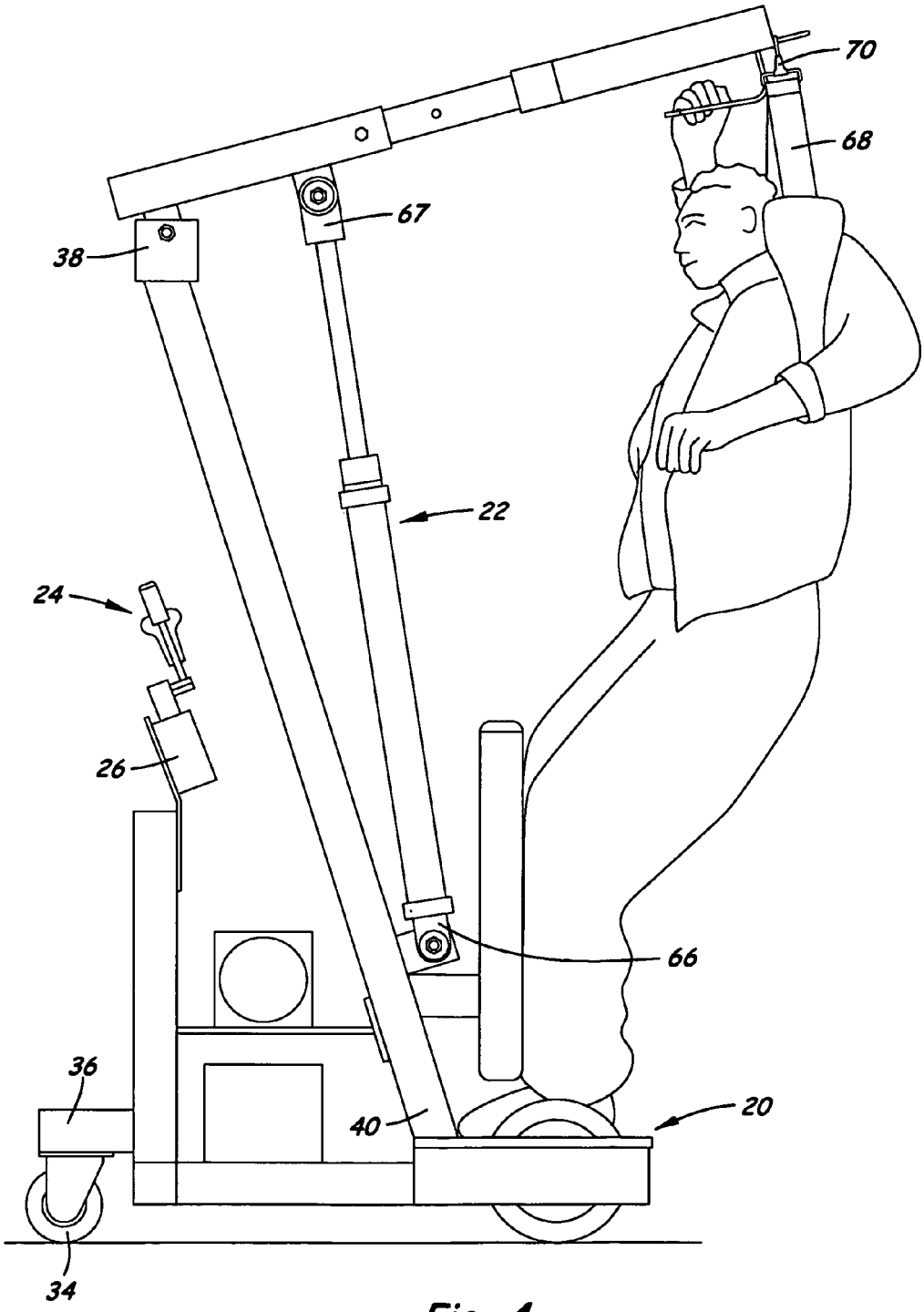
FIG. 4 is a schematic side view of the powered person lift and transport apparatus engaging and lifting a human body.

With reference now to the drawings, and in particular to FIGS. 1 through 4 thereof, a new powered person lift and transport apparatus embodying the principles and concepts of the disclosed subject matter will be described.

The disclosure relates to a powered person lift and transport apparatus 10 that utilizes a unified hydraulic power source for both moving the apparatus across a ground surface and for lifting and lowering a human body. The motorized hydraulic lift apparatus 10 is highly suitable for lifting and moving a human body in an indoor or outdoor environment, particularly due to the relatively compact footprint of the apparatus and the maneuverability of the apparatus.

The disclosure generally relates a motorized hydraulic lift apparatus for lifting and transporting a human body above a ground surface. The apparatus 10 generally includes a base 12, a mast 14 extending upwardly from the base, and a crane member 16 pivotally mounted on the mast and movable with respect to the base. The apparatus my further include a knee pad 18 for abutting against a knee of a body when the body is being lifted. The apparatus further includes a hydraulic drive mechanism 20 for moving the base over the surface, a hydraulic lifting mechanism 22 for moving the crane member with respect to the base, and preferably a single hydraulic power source assembly 24 is connected to and powers both the hydraulic drive mechanism 20 and the hydraulic lifting mechanism 22. The hydraulic power source 24 may include a control assembly 26 for powering and controlling the hydraulic drive mechanism 20 and the hydraulic lifting mechanism 22.

The base 12 may include a rear frame portion 28 attached to a front frame portion 30, a foot platform 32 for supporting the feet of a human body being transported by the apparatus, and an auxiliary support wheel 34 for supporting the base over a ground surface. The rear frame portion 28 may have a first side and a second side located opposite of the first side on the frame portion 28. The second side of the rear frame portion 28 is located toward the body to be lifted when the apparatus 10 is used transport the body. The rear frame portion 28 may also have a left side and a right side extending between the first and second sides. The left and right sides of the rear frame portion 28 may converge toward each other toward the first side of the frame portion 28, and may diverge away from each other toward the second side of the portion 28, to form a substantially trapezoidal structure when viewed from above. The rear frame portion 28 may have a support bracket 36 extending away from the first side of the rear frame portion, such that the support bracket may be oriented substantially perpendicular to the first side of the rear frame portion. The front frame portion 30 may also have a first side and a second side, which is located opposite of the first side. The second side of the front frame portion 30 may be connected to the first side of the rear frame portion 28. The front frame portion 30 may also have a left side and a right side connected to the respective left side and right side of the rear frame portion 28.

The foot platform 32 may be mounted on the front frame portion 30, and may include a substantially continuous top surface. In an illustrative embodiment, the foot platform 32 may also include a supporting understructure for supporting the weight of a human body placed on the top surface of the foot platform. The auxiliary support wheel 34 may be mounted to the rear frame portion 28, and more specifically may be mounted on the support bracket 36. The auxiliary support wheel 34 may comprise a caster that is freely rotatable about a center hub. The wheel 34 may be rotatable about a substantially horizontal axis, and may also be swivelable about a substantially vertical axis.

The mast 14 may be elongated, and may extend upwardly from the base in order to support the crane member 16. The mast 14 may have a top end 38 and a bottom end 40, and the bottom end of the mast may be attached to the base 12 at a substantially central location on the base, and may be connected to the front frame portion 30 of the base. In an illustrative embodiment, the mast 14 extends upwardly and rearwardly from the base 12 such that the mast is inclined rearwardly as it extends upwardly from the base.

The crane member 16 may be pivotally mounted on the mast 14 so that the crane member is pivotable in a substantially vertical plane. In an illustrative embodiment, the crane member 16 pivots between a lowered position, which is relatively closer to the base, and a raised position, which is relatively further away from the base. The crane member 16, which may be elongated, may be mounted to the top end 38 of the mast 14. The crane member 16 may comprise an assembly that includes a primary arm 42 mounted on the mast 14 and an extension arm 44 that may be at least partially received by the primary arm. The primary arm 42 may have a first end 46 and a second end 48, and the first end of the primary arm may be positioned between a pair of ears mounted on the top end 38 of the mast 14, and bolt may extend through the pair of ears and the first end 46 to create a pivotable relationship between the primary arm and the mast. The second end 48 of the primary arm may have an opening into a recess formed in the primary arm 42 to receive a portion of the extension arm 44. The overall or effective length of the crane member 16 may be increased by extending the extension arm from the primary arm or decreased by retracting a portion of the extension arm into the primary arm. The position of the extension arm with respect to the primary arm may be fixed, and thus the length of the crane member set, using a securing device such as a pin or bolt fastener that is inserted into aligned holes in the extension arm and the primary arm to thereby prevent the extension arm from extending or retracting relative to the primary arm.

The extension arm 44 may have a first end 50 and a second end 52, with the first end 50 being inserted into and received by the opening on the second end 48 of the primary arm. The second end 52 of the extension arm 44 may have a bracket 54 or loop for receiving a hook, and a handle 56. In an illustrative embodiment, the second end 52 of the extension arm may be bifurcated and have a pair of laterally spaced apart arm members 58, 60. Each arm member 58, 60 may have a bracket 54 for receiving a hook and each arm member handle 58, 60. In this illustrative embodiment, a human being lifted by the device may grab the handle on each of the arm members with one of his or her hands. A belt 68 may be removably attached to the crane member 16 for helping to secure the human body to the apparatus 10. In an illustrative embodiment, the belt 68 may have opposed ends, may be elongate and may be flexible. In order to attach the belt 68 to the crane member 16, a hook 70 may be located at each end of the belt. In an illustrative embodiment, the hook 70 may be hooked onto the bracket 54 of the extension arm 44.

The knee pad 18 may be positioned adjacent to and above the foot platform 32. In an illustrative embodiment, the knee pad 18 may be mounted on the mast 14 toward the bottom end 40 of the mast. The knee pad 18 may have a resiliently cushioned surface for contacting the knees of a body being lifted by the crane member 16 of the apparatus 10. The surface may have a variety of different surface areas to ensure that the knees of a variety of differently sized bodies may contact the knee pad. The knee pad 18 may have a height and a width. Illustratively, the height of the knee pad 18 may be between approximately one foot and approximately four feet and the width of the knee pad may be between approximately one foot and approximately three feet.

The hydraulic drive mechanism 20 may include a pair of wheels 62, 63 mounted to the base and a pair of hydraulic motors 64, 65 for driving each wheel 62, 63 of the pair of wheels independently of each other in a manner that not only causes movement of the base 12 across the surface but also permits steering of the base with respect to the surface by changing and turning the orientation of the base about a vertical axis. In an illustrative embodiment, the pair of wheels 62, 63 may be rotatable about a substantially common axis such that one wheel 62 of the pair of wheels is positioned toward a left side of the base 12 and another wheel 63 of the pair of wheels is positioned toward a right side of the base. The wheels may each have a center rotating hub. A drive shaft of each motor is directly linked to the hub of an associate wheel. Motion imparted on the pair of wheels by the pair of hydraulic motors will cause the base to move across the ground surface. If the both wheels of the pair of wheels are turned at the same rate, the base will move in a forward or backward direction, depending on the direction of rotation of the wheels, without rotation of the base about a vertical axis. By rotating one wheel of the pair of wheels at a rate that is relatively faster than rotation of the other wheel, the base can be turned or otherwise maneuvered about a substantially vertical axis. If the left wheel is rotated at a speed greater than rotation of the right wheel, the base will generally turn in the direction of the right wheel. Conversely, if the right wheel is rotated at a rate greater than the left wheel, the base will generally turn in the direction of the left wheel. The rate at which each hydraulic motor of the pair of motors turns may be controlled by the rate at which hydraulic fluid flows through the motor. In order to turn a motor at a slow rate, the flow of hydraulic fluid to that motor is restricted. In order to increase the rate at which a motors turn, the flow of hydraulic fluid to that motor is increased.

The hydraulic lifting mechanism 22 moves the crane member 16 with respect to the mast 14, and thus the base 12. The lifting mechanism 22 may link the crane member 16 to the mast 14. The hydraulic lifting mechanism 22 may have a first end 66 that is pivotally connected to the mast 14 and a second end 67 that is pivotally connected to the crane member 16. Optionally, the first end 66 of the hydraulic lifting mechanism may be pivotally connected to the base 12. The hydraulic lifting mechanism 22 may comprise a hydraulically-actuated ram and cylinder arrangement that is substantially linearly extendable and contractible, and connected such that extension imparts a lifting force on the crane member 16 with respect to the base 12.

The hydraulic power source assembly 24 provides both power and control for the hydraulic drive mechanism and hydraulic lifting mechanism, preferably in a single common unified unit. In an illustrative embodiment, the hydraulic power source assembly 24 may include a hydraulic pump 72 and a fluid tank 74, both of which may be coupled to the base 12. The pump 72 may provide hydraulic pressure to drive the hydraulic drive mechanism 20 and the hydraulic lifting mechanism 22. The hydraulic pump 72 may be powered by a battery, but may also be powered by any suitable electric (or other) power source. The hydraulic power source assembly 24 may also include the control assembly 26 to control the movement of fluid from the single power source to the mechanisms 20, 22.

The control assembly 24 may include a plurality of user operable controls coupled to the plurality of hydraulic valves 76 for controlling the rate of and direction of fluid flow through the valves. The plurality of hydraulic valves 76 may be configured to control fluid flow from the hydraulic pump 72 to the pair of hydraulic motors 64, 65 of the hydraulic drive mechanism 20 and to the ram and cylinder of the hydraulic lifting mechanism 22. In an illustrative embodiment, each valve of the plurality of hydraulic valves 76 may be sensitive to a predetermined physical pressure such that sufficient pressure imparted on the valve 76 by a human being can partially activate or fully activate the valve. Illustratively, each valve 76 may be independently adjustable to control the direction of fluid flow through the valve. Each valve may also be independently adjustable to control the rate of fluid flow through the valve.

In an illustrative embodiment, the plurality of hydraulic valves 76 may include a first valve, a second valve, and a third valve. The first valve may be used to control the rate and direction of fluid flow from the hydraulic pump 72 to the hydraulic lifting mechanism 22 to control the pivotal movement of the crane member 16 by the ram and cylinder. The second valve may be used to control the rate and direction of fluid flow from the hydraulic pump 72 to a left one 64 of the hydraulic motors for controlling the direction and speed of rotation of the hydraulic motor and the attached wheel 62. Similarly, the third valve may be used to control the rate and direction of fluid flow from the hydraulic pump 72 to a right one 65 of the hydraulic motors for controlling the direction and speed of rotation of the hydraulic motor and the attached wheel 63. In an embodiment, two valves may be employed with a first valve controlling the hydraulic lifting mechanism 22 and a second valve controlling the speed and direction of movement of the base 12. In this embodiment, the second valve would be connected to both motors 64, 65 of the hydraulic drive assembly 20, modulating the flow of hydraulic fluid to both motors at the same time in order to control the direction and speed of travel of the base.

A plurality of fluid conduits 78 may link the hydraulic pump 72 to the valves 76, and in turn the valves 76 to motors 64, 65 of the hydraulic drive mechanism 20 and the valves 76 to the ram and cylinder arrangement of the hydraulic lifting mechanism 22. The plurality of fluid conduits 78 may form hydraulic circuits for placing the hydraulic pump in fluid communication with the hydraulic drive mechanism and the hydraulic lifting mechanism.

Illustratively, one method of using the apparatus includes the steps of positioning the apparatus 10 so that an outboard end of the crane member 16 is located near the human body to be lifted, preferably in a position that is close to the shoulders and chest of the body. The body may be secured to the crane member 16 using the belt 68, hooks 70, and the brackets 54 to the crane member 16. The hydraulic lifting mechanism 22 may be activated using the appropriate valves 76 to lift the crane member 16 and elevate the attached human body above the ground, or at least to a standing position. Once the body is lifted from the ground, the hydraulic drive mechanism 20 may be actuated using the valves 76 to transport the apparatus 10 and body to a desired location. Once at the desired location, the hydraulic lifting mechanism 22 may be actuated via the valves to lower the crane member 16 and the body in the desired location, at which point the human body may be released from the crane member by removing the belt 68 and hooks 70 from the crane member 16.

With respect to the above description then, it is to be realized that the optimum dimensional relationships for the parts of the invention, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. A powered lift apparatus for lifting and transporting a human body above a ground surface, the apparatus comprising:

a base;

a mast extending upwardly from the base;

a crane member pivotally mounted on the mast and movable with respect to the base;

a hydraulic drive mechanism configured to move the base over the surface;

a hydraulic lifting mechanism configured to move the crane member with respect to the base; and a single hydraulic power source assembly connected to and powering both the hydraulic drive mechanism and hydraulic lifting mechanism, the hydraulic power source assembly including a control assembly configured to direct hydraulic power from the hydraulic power source assembly to the hydraulic drive mechanism and hydraulic lifting mechanism under user control.

2. The apparatus of claim 1, wherein the hydraulic drive mechanism comprises:

a pair of wheels mounted to the base, a pair of hydraulic motors, each of the hydraulic motors driving one wheel of the pair of wheels to move the base across the surface, each of the hydraulic motors driving the respective one of the wheels independently of the other wheel of the pair of wheels to steer movement of the base with respect to the surface.

3. The apparatus of claim 2, wherein the base comprises an auxiliary support wheel mounted on the base at a location spaced from the pair of wheels, the auxiliary support wheel being freely rotatable about a substantially horizontal axis and about a vertical axis.

4. The apparatus of claim 2, wherein the pair of wheels are located toward a front of the base, the pair of wheels being rotatable about a substantially common axis.

5. The apparatus of claim 1, wherein the hydraulic lifting mechanism comprises an extendable and contractible ram acting between the mast and the crane member to pivot the crane member with respect to the mast.

6. The apparatus of claim 1, wherein the hydraulic power source assembly includes a hydraulic pump in communication with the control assembly, the control assembly controlling flow of hydraulic fluid from the hydraulic pump to the hydraulic drive mechanism and the hydraulic lifting mechanism.

7. The apparatus of claim 1, wherein the base has a front and a rear, and wherein the mast has a top end and a bottom end attached to the base at a substantially central location on the base, the mast extending upwardly and rearwardly from the base such that the mast is inclined.

8. The apparatus of claim 1, wherein the crane member is pivotable in a substantially vertical plane, the crane member being pivotal between a lowered position in which the crane member is oriented relatively closer to the base and a raised position in which the crane member is oriented relatively further away from the base.

9. The apparatus of claim 1, wherein a portion of the crane member is extendable and retractable with respect to another portion of the crane member to increase and decrease a length of the crane member.

10. The apparatus of claim 1, wherein the crane member comprises:

a primary arm mounted on the mast; and an extension arm mounted on the primary arm, the extension arm being extendable and retractable with respect to the primary arm.

11. The apparatus of claim 10, wherein the extension arm includes a bracket for receiving a hook of a sling and the extension arm includes a handle located proximate to the bracket.

12. The apparatus of claim 11, further comprising a belt for securing a human body to the crane, the belt having opposed ends with a hook mounted on each of the opposed ends, the hooks being removably attached to the brackets of the extension arm of the crane member.

13. The apparatus of claim 10, wherein the extension arm is bifurcated and includes a pair of laterally spaced arm members.

14. The apparatus of claim 1, further comprising a knee pad for abutting a knee of a human body when the human body is lifted by the apparatus, the knee pad being mounted on the mast.

15. The apparatus of claim 14, wherein the base comprises a foot platform for supporting the feet of a human body being transported by the apparatus, the foot platform being positioned adjacent to and below the knee pad.

16. The apparatus of claim 1, wherein the hydraulic drive mechanism comprises:

a pair of wheels mounted to the base, a pair of hydraulic motors, each of the hydraulic motors driving one wheel of the pair of wheels to move the base across the surface, each of the hydraulic motors driving the respective one of the wheels independently of the other wheel of the pair of wheels to steer movement of the base with respect to the surface;

wherein the base comprises an auxiliary support wheel mounted on the base at a location spaced from the pair of wheels, the auxiliary support wheel being freely rotatable about a substantially horizontal axis and about a vertical axis;

wherein the pair of wheels are located toward a front of the base, the pair of wheels being rotatable about a substantially common axis;

wherein the hydraulic lifting mechanism comprises an extendable and contractible ram acting between the mast and the crane member to pivot the crane member with respect to the mast;

wherein the hydraulic power source assembly includes a hydraulic pump in communication with the control assembly, the control assembly controlling flow of hydraulic fluid from the hydraulic pump to the hydraulic drive mechanism and the hydraulic lifting mechanism;

wherein the base has a front and a rear;

wherein the mast has a top end and a bottom end attached to the base at a substantially central location on the base, the mast extending upwardly and rearwardly from the base such that the mast is inclined;

wherein the crane member is pivotable in a substantially vertical plane, the crane member being pivotal between a lowered position in which the crane member is oriented relatively closer to the base and a raised position in which the crane member is oriented relatively further away from the base;

wherein a portion of the crane member is extendable and retractable with respect to another portion of the crane member to increase and decrease a length of the crane member;

wherein the crane member comprises:

a primary arm mounted on the mast; and an extension arm mounted on the primary arm, the extension arm being extendable and retractable with respect to the primary arm;

wherein the extension arm includes a bracket for receiving a hook of a sling and the extension arm includes a handle located proximate to the bracket;

a belt for securing a human body to the crane, the belt having opposed ends with a hook mounted on each of the opposed ends, the hooks being removably attached to the brackets of the extension arm of the crane member;

wherein the extension arm is bifurcated and includes a pair of laterally spaced arm members;

a knee pad for abutting a knee of a human body when the human body is lifted by the apparatus, the knee pad being mounted on the mast; and wherein the base comprises a foot platform for supporting the feet of a human body being transported by the apparatus, the foot platform being positioned adjacent to and below the knee pad.

* * * * *